United States Patent [19]

O'Brien

[11] 4,452,461

[45] Jun. 5, 1984

[54] BOOMERANG

[75] Inventor: Mark J. O'Brien, Denver, Colo.

[73] Assignee: Kona Associates Limited Partnership, New Haven, Conn.

[21] Appl. No.: 409,119

[22] Filed: Aug. 18, 1982

Related U.S. Application Data

[63] Continuation of Ser. No. 186,231, Sep. 11, 1980, abandoned.

[51] Int. Cl.[3] ..... A63B 65/08

[52] U.S. Cl. ..... 273/426

[58] Field of Search ..... 273/426

[56] References Cited

U.S. PATENT DOCUMENTS

| | | | |
|---|---|---|---|
| D. 201,625 | 7/1965 | Marler . | |
| D. 221,967 | 9/1971 | Sheard . | |
| D. 239,403 | 3/1976 | Jarvis . | |
| D. 241,361 | 9/1976 | Crew . | |
| D. 243,029 | 1/1977 | Crew . | |
| 477,748 | 6/1892 | Emerson . | |
| 510,290 | 12/1893 | Renear . | |
| 692,608 | 2/1902 | Bristow . | |
| 862,094 | 7/1907 | Morton . | |
| 906,206 | 12/1908 | Kawes . | |
| 1,040,702 | 10/1912 | Lee . | |
| 1,368,176 | 2/1921 | McMillan . | |
| 1,547,558 | 7/1925 | Browne . | |
| 1,826,905 | 10/1931 | Tantlinger . | |
| 2,361,988 | 11/1944 | Bonnifield . | |
| 2,969,609 | 1/1961 | Kowalski . | |
| 2,972,481 | 2/1961 | Shapiro | 273/426 |
| 3,036,832 | 5/1962 | Ellman et al. . | |
| 3,403,909 | 10/1968 | Cleveland et al. . | |
| 3,403,910 | 10/1968 | Claycomb . | |
| 3,565,434 | 2/1971 | Liston . | |
| 3,595,578 | 7/1971 | Burcenski . | |
| 3,881,729 | 5/1975 | Block et al. . | |
| 3,955,817 | 5/1976 | Davis . | |

FOREIGN PATENT DOCUMENTS

| | | | |
|---|---|---|---|
| 289489 | 8/1966 | Australia | 273/426 |

OTHER PUBLICATIONS

"Proceedings of the Second Workshop on Wind Energy Conversion Systems", Washington, D.C. 6/75.
Playthings 4-1959, p. 115, Cloud Climer #255.
Jetco Models Thermic "Trio" JE-SG-005.
"Dutch Windmills" by the 'Prinsenmolen'-Committee.
Engineer' Illustrated Thesaurus, Herbert Herkimer.

*Primary Examiner*—Paul E. Shapiro

[57] ABSTRACT

A cross-stick boomerang has its leading edges or trailing edges substantially aligned. The outermost portion of each blade extends farther to the rear than does the general line of the trailing edge. In one version, an inner fin is provided inwardly of the outer fin, and in another version the hub portion is enlarged to provide a generally circular shape.

8 Claims, 8 Drawing Figures

BOOMERANG

This application is a continuation of application Ser. No. 186,231, filed 9/11/80, now abandoned.

BACKGROUND OF THE INVENTION

The present invention is directed to boomerangs, and it is intended primarily to be applied to boomerangs used for recreational purposes.

The archetypal V-shaped boomerang was used primarily as a weapon for hunting, the intent being to return the boomerang to the vicinity of the thrower only when the target was not hit. No attempt ordinarily was made to catch the boomerang, and such an attempt would have been dangerous because boomerangs of this type typically dash downwardly during the last few seconds of flight, making it quite likely for the thrower to catch the boomerang somewhere other than in the palm of his hand. Accordingly, the aboriginal users of this type of boomerang were ordinarily satisfied to allow the boomerang to fall to the ground before retrieving it. Although this mode of operation was satisfactory for hunting purposes, it is thought that its use as a toy was somewhat limited. If it were safe to attempt to catch the boomerang at the end of its flight, on the other hand, a fairly engaging game would result.

A design that is somewhat more suited for recreational purposes is the cross-stick boomerang, which is less dangerous than the V-shaped type. However, it is ordinarily somewhat difficult to obtain very much distance with the standard cross-stick device. In addition, the conventional cross-stick boomerang tends to return quickly, often without achieving very much height. This is desirable for recreational purposes because the boomerang may thereby not give the thrower enough time to position himself beneath it as it returns.

It is accordingly the object of the present invention to adapt the cross-stick booomerang more effectively for recreational application by achieving greater distance and a more leisurely rate of descent.

SUMMARY OF THE INVENTION

The foregoing and related objects are achieved in a boomerang having a hub portion and a plurality of substantially diametrically opposed pairs of elongated blade portions extending outwardly from the hub portion and lying in a common plane. Each of the blade portions generally provides an airfoil configuration in cross section. Either the leading edges or the trailing edges of the opposed blade portions are in substantial alignment. Preferably, each of the blade portions includes a fin portion adjacent its outer end whose trailing edge extends farther in the rearward direction than does the trailing edge of the major portion of the remainder of the blade portion.

The hub portion may include web portions extending between adjacent blade edges and having arcuate outer edges that are concentric to provide a generally circular edge interrupted by the blade portions. In one illustrated embodiment, the leading edges of the diametrically opposed pairs are in substantial alignment. Each of the blade portions of that embodiment includes a further fin portion lying inwardly of the first-mentioned fin portion and extending farther in the rearward direction than does the rest of the blade portion lying inwardly of the first-mentioned fin portion. In another embodiment, it is the trailing edges that are in substantial alignment in the diametrically opposed pairs.

The boomerangs illustrated in the accompanying drawings both have only two pairs of elongated blade portions. The two pairs lie in perpendicular relationship, and each of the leading edges of the blade portions is substantially rectilinear.

BRIEF DESCRIPTION OF THE DRAWINGS

Further features and advantages of the present invention are described in connection with the accompanying drawings, in which.

DETAILED DESCRIPTION OF THE PREFERRED EMBODIMENT

FIGS. 1–6 illustrate a boomerang that has been found particularly effective for recreational purposes. When compared with a conventional cross-stick boomerang, it achieves a higher angular velocity for a given throwing force, a greater distance before return, and a more leisurely rate of return. The longer time for return serves to allow the user enough time to position himself underneath the boomerang so that he can catch it. Furthermore, many boomerangs following the teachings below execute a spiral on the return trip that is tighter and more defined than spiral paths followed by conventional cross-stick devices. Such paths are thought to be more predictable and more pleasing to watch.

Figure 1:
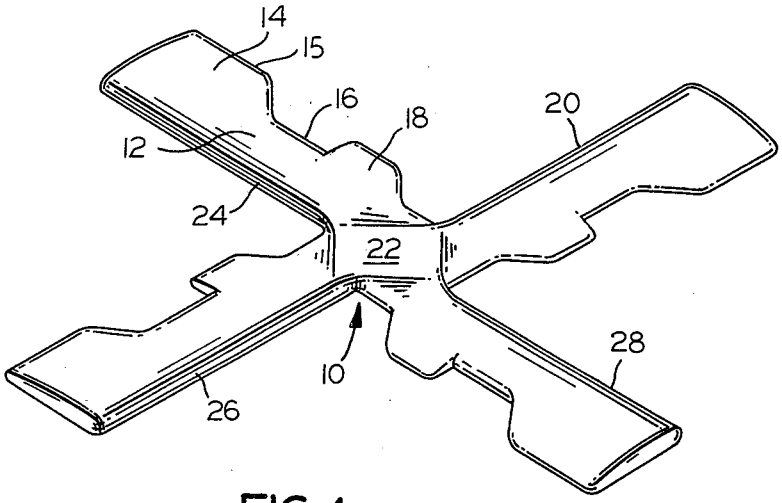
FIG. 1 is a perspective view of a booomerang that follows the teachings of the present invention.
Figure 2:
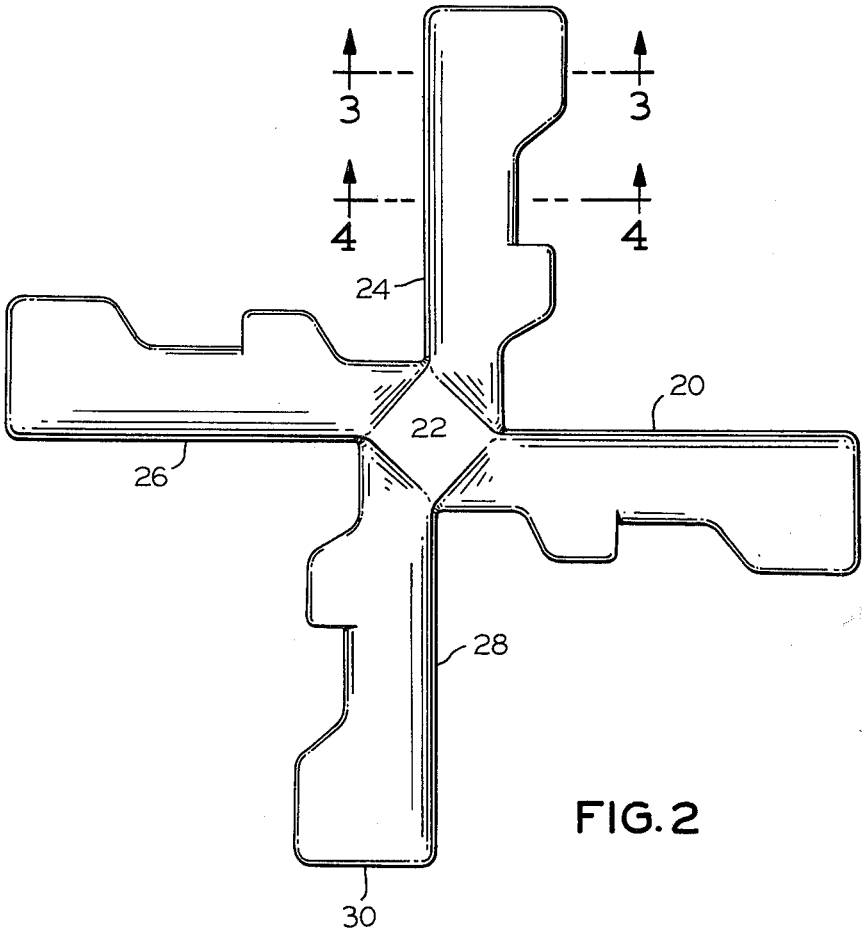
FIG. 2 is a plan view of the boomerang of FIG. 1.
Figure 6:
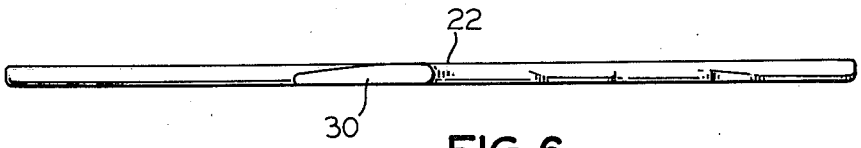
FIG. 6 is an elevational view of the boomerang of FIG. 1.
Figure 5:
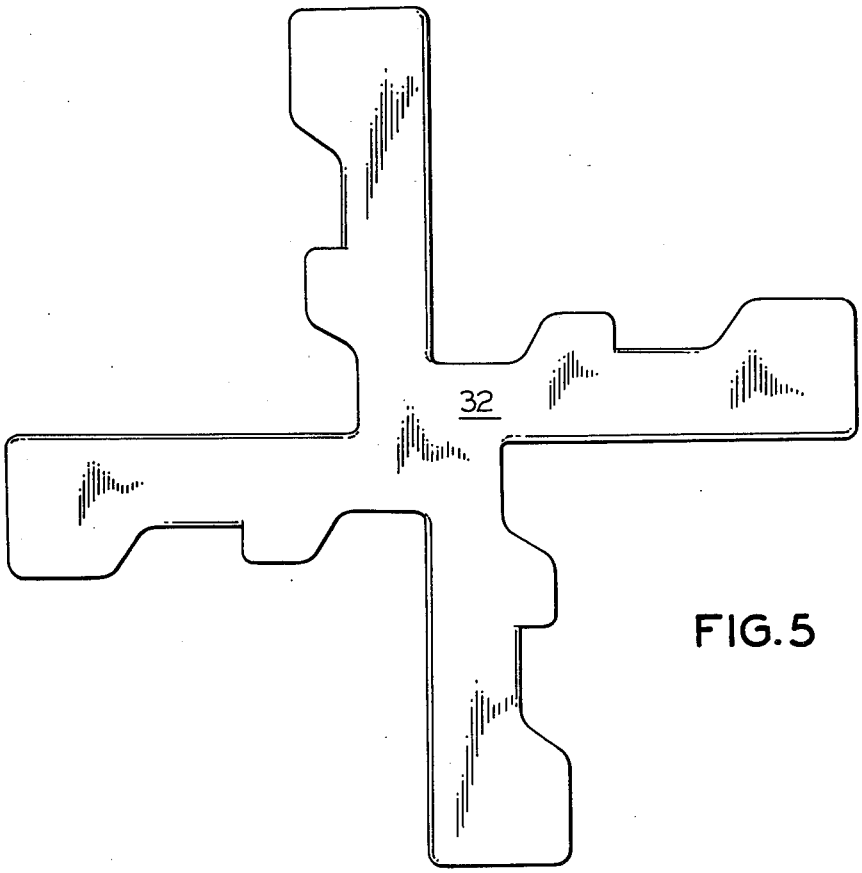
FIG. 5 is a bottom view of the boomerang of FIG. 1.
Figure 4:
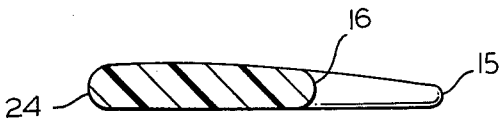
FIG. 4 is a cross-sectional view taken at line 4—4 of FIG. 2.

The illustrated boomerang includes two pairs of opposed blades 12 that extend outwardly of a central hub having a flat, square upper surface 22. As FIG. 4 illustrates, each blade provides an airfoil configuration in cross section with a leading edge 24 and a trailing edge 16. It is thought that the advantages of the boomerang illustrated in FIGS. 1–6 arise largely from the fact that leading edges of opposed blades are in substantial alignment. This is best seen in FIG. 2, where it is apparent that leading edges 24 and 28 are nearly on a common line, extending diametrically from the central hub, as are leading edges 20 and 26. This contrasts with the conventional cross-stick boomerang, in which leading edges are ordinarily aligned with trailing edges.

In addition to the aligned leading edges, another feature that seems to contribute significantly to the advantages of the illustrated boomerang is an enlarged fin region 14 at the end of each blade portion. As is best seen in FIGS. 1 and 2, the leading edge of this widened fin region is on substantially the same line as the leading edge of the remainder of the blade portion, so the leading edge of the entire blade portion is substantially rectilinear. The fin regions trailing edge 15, on the other hand, extends significantly to the rear of the trailing edge 16 of the major portion of the remainder of the blade. As FIG. 3 illustrates, this tab portion 14, like the remainder of the blade portion, provides an airfoil contour in cross section.

Although it is thought desirable for the outer portion of each blade to be generally wider than the rest of the blade (hence the provision of fin region 14), it has been found that the stability of the design is enhanced if a further tab or fin 18 is provided along the inner portion of each blade. Like fin region 14, fin region 18 extends farther to the rear than does most of the inner portion of trailing edge 16.

Figure 3:
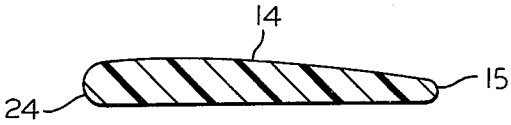
FIG. 3 is a cross-sectional view taken at line 3—3 of FIG. 2.

The airfoil contours illustrated in FIGS. 3 and 4 continue throughout the lengths of the blades up to the hub portion, where the flat bottom surface continues, thereby resulting in a substantially planar bottom surface 32 for the entire boomerang. The upper surface of the hub portion provides a square, flat plateau 22 whose thickness is the same as that of the thickest portion of the blades adjacent their leading edges. The surface tapers from the edges of plateau 22 to assume the airfoil contour illustrated in FIGS. 3 and 4.

Although it has been found that the performance and characteristics of a boomerang of the type illustrated in the drawings vary significantly with changes in dimensions, it has also been found that satisfactory and advantageous performance results from a wide range of sizes and relative proportions of the various portions of the boomerang. The shape illustrated in FIG. 2 performs well in a boomerang having a distance between the tips of opposite blades of 14½ inches (37 cm.). A recommended airfoil for a boomerang of that size would be around ¼ inch (0.6 cm.) at its thickest point, tapering down to about ⅛ inch (0.3 cm.) before being rounded at the trailing edge.

Although most of the models that have been tested so far have been made of balsa wood, the drawings indicate the use of plastic because it is thought that some type of plastic will be used in production versions of the boomerang.

Figure 7:
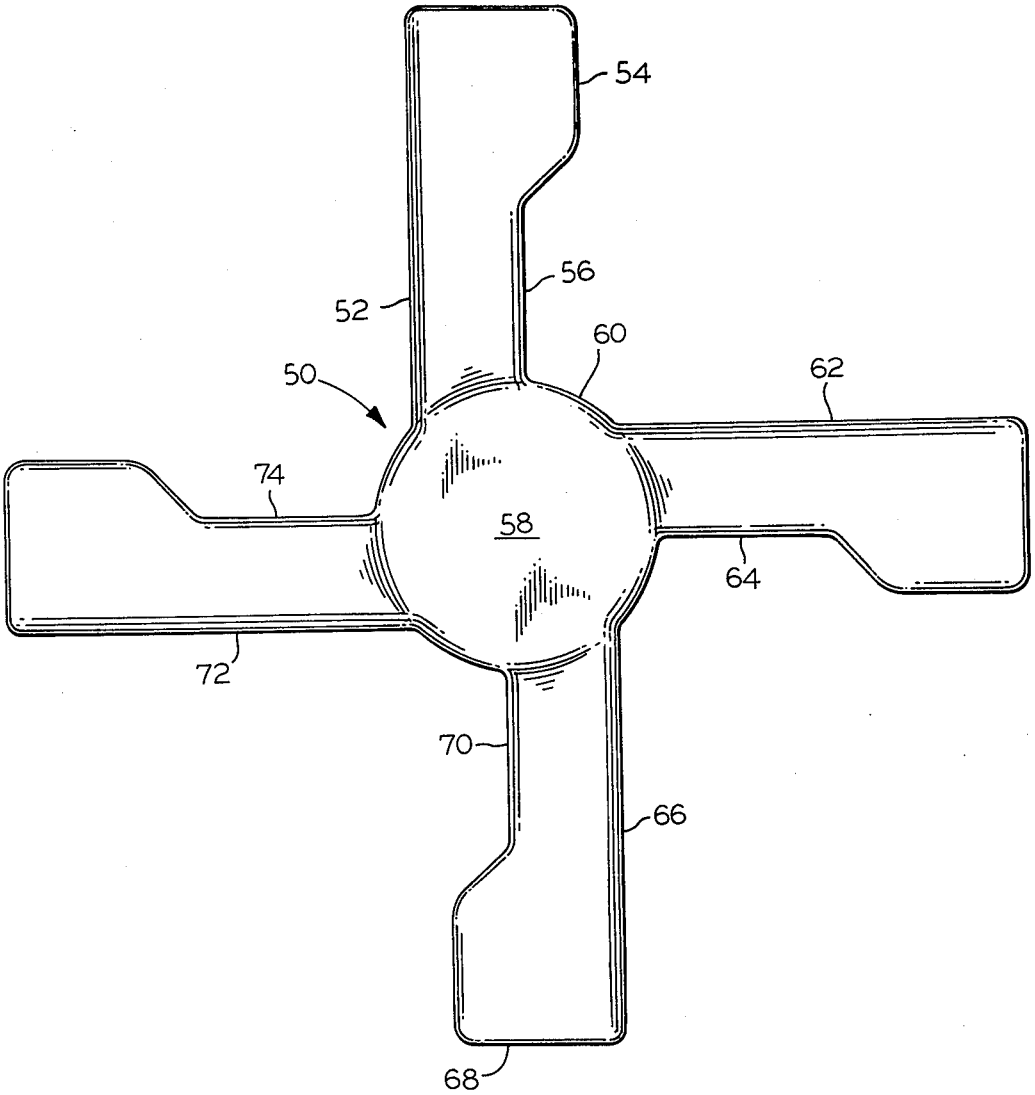
FIG. 7 is a plan view of an alternate version of the boomerang of the present invention.
Figure 8:
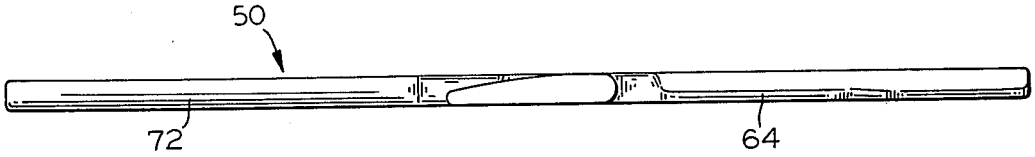
FIG. 8 is an elevational view of the boomerang of FIG. 7.

The increased angular velocity that appears to flow from aligning the leading edges of the blade portions also seems to result when the trailing edges are in substantial alignment. Such an arrangement is illustrated in FIGS. 7 and 8. In contrast with the leading edges in the version of FIGS. 1–6, leading edges 52 and 66 of FIGS. 7 and 8 are not in alignment, and leading edges 62 and 72 are also offset. In the arrangement of FIGS. 7 and 8, it is the trailing edges that are aligned. Trailing edges 56 and 70 are in substantial alignment, as are trailing edges 64 and 74, although each blade portion does have a tab portion whose trailing edge 54 extends rearwardly of the common line of the major portion of the trailing edge.

The arrangement of FIGS. 7 and 8 also differs from that of FIGS. 1–6 in that its hub portion 58 has a somewhat circular shape. Adjacent edges of the blade portions do not meet in a right angle as they do in the arrangement of FIGS. 1–6. Instead, hub portion 58 includes web portions that extend between adjacent blade edges to provide concentric arcuate edges 60. Arcuate edges 60 together provide a circular hub shape that is interrupted by the outwardly extending blades. This hub shape is provided in lieu of the inner fin regions 18 of FIGS. 1–6, and its purpose is the same, i.e., to increase stability. The circular hub can be included whether it is the leading edges or the trailing edges that are in alignment, but it is especially useful when it is the trailing edges that are in alignment because it has been found that inner fin regions detract somewhat from the performance of the boomerang when the trailing edges are aligned.

The circular-hub shape can also be used in conjunction with the inner fin, although the stability afforded by the inner fin is ordinarily sufficient without the addition of the circular hub. Furthermore, although the stabilizing influence of the circular hub and the inner fin is desirable, boomerangs constructed without either have achieved satisfactory performance.

It is preferred that hub portion 58, like the hub of FIGS. 1–6, only be as thick as the thickest regions of the blade portions.

By following the teachings of the present invention, a boomerang can be designed that outperforms the standard cross-stick boomerang. It achieves a higher angular velocity for a given throwing force, it tends to travel farther before returning, and its time for return is greater, so it is easier to catch. Furthermore, with the provision of the inner tab or the circular hub, the stability of the boomerang flight is enhanced so that it maintains the orientation necessary for the proper function of the airfoil cross section.

Having thus described the invention, I claim:

1. A boomerang having a hub portion and a plurality of substantially diametrically opposed pairs of elongated blade portions extending outwardly from said hub portion and lying in a common plane, each of said blade portions generally providing an airfoil configuration in cross section, said blade portions having the leading edges thereof in substantial alignment in the diametrically opposed pairs; each of said blade portions including a fin portion adjacent the outer end thereof whose trailing edge extends farther in the rearward direction than does the trailing edge of the major portion of the remainder of said blade portion.

2. The boomerang of claim 1 wherein said hub portion includes web portions extending between adjacent blade edges, said web portion having arcuate outer edges that are concentric to provide a generally circular edge interrupted by said blade portions.

3. The boomerang of claim 1 wherein each of said blade portions includes a further fin portion lying inwardly of said first-mentioned fin portion and extending farther in the rearward direction than does the rest of the blade portion lying inwardly of said first-mentioned fin portion.

4. The boomerang of claim 3 wherein a first portion of said trailing edge extends from said fin portion to said further fin portion and a second portion of said trailing edge extends from said further fin portion to said hub portion, said first portion extending farther in the rearward direction than said second portion.

5. A boomerang having a hub portion and a plurality of pairs of opposed elongated blade portions extending outwardly from said hub portion and lying in a common plane, each of said blade portions generally providing an airfoil configuration in cross section, said opposed blade portions of each of said pairs having their leading edges aligned nearly on a common line extending diametrically from said hub portion, each of said blade portion including a fin portion adjacent the outer end thereof whose trailing edge extends farther in the rearward direction than does the trailing edge of the major portion of the remainder of said blade portion.

6. The boomerang of claim 5 wherein each of said leading edges is substantially rectilinear.

7. A boomerang having a hub portion and a plurality of substantially diametrically opposed pairs of elongated blade portions extending outwardly from said hub portion and lying in a common plane, each of said blade portions generally providing an airfoil configuration in cross section, said blade portions having trailing edge elements adjacent said hub portion in substantial alignment in the diametrically opposed pairs, each of said blade portions including a fin portion adjacent the outer end thereof whose trailing edge extends farther in the rearward direction than does said trailing edge element thereof adjacent said hub.

8. The boomerang of claim 5 or 7 having only two of said pairs of elongated blade portions, said two pairs of blade portions lying in perpendicular relationship.

* * * * *